US006702494B2

(12) United States Patent
Dumler et al.

(10) Patent No.: US 6,702,494 B2
(45) Date of Patent: Mar. 9, 2004

(54) COSMETIC UNIT

(75) Inventors: Norbert Dumler, Ansbach (DE); Werner Fischer, Burk (DE)

(73) Assignee: Geka Brush GmbH, Bechhofen (DE)

( * ) Notice: Subject to any disclaimer, the term of this patent is extended or adjusted under 35 U.S.C. 154(b) by 0 days.

(21) Appl. No.: 10/397,316

(22) Filed: Mar. 27, 2003

(65) Prior Publication Data

US 2003/0185616 A1 Oct. 2, 2003

(30) Foreign Application Priority Data

Mar. 27, 2002 (DE) ..... 102 13 643

(51) Int. Cl.[7] ..... B05C 1/00; B43K 27/02

(52) U.S. Cl. ..... 401/17; 401/18; 132/317; 206/581; 206/515

(58) Field of Search ..... 401/16, 17, 18, 401/23, 24, 25, 26, 34; 132/317, 318; 220/23.83, 380; 206/223, 581, 499, 515, 519, 520, 508

(56) References Cited

U.S. PATENT DOCUMENTS

| | | | | |
|---|---|---|---|---|
| 2,292,939 A | | 8/1942 | Hollenbeck et al. | |
| 3,690,777 A | | 9/1972 | Costa | |
| 5,509,742 A | | 4/1996 | Balzarini | |
| 6,276,853 B1 | * | 8/2001 | Breidenbach et al. | 401/18 |
| 6,450,179 B2 | * | 9/2002 | Bengis | 401/18 |
| 6,505,631 B2 | | 1/2003 | Fischer et al. | |

FOREIGN PATENT DOCUMENTS

| | | | | |
|---|---|---|---|---|
| DE | 197 33 290 A1 | | 2/1999 | |
| DE | 100 29 378 A1 | | 1/2002 | |
| DE | 100 39 490 A1 | | 2/2002 | |
| FR | 989522 | * | 9/1951 | 401/18 |

* cited by examiner

*Primary Examiner*—David J. Walczak
(74) *Attorney, Agent, or Firm*—Browdy and Neimark, P.L.L.C.

(57) ABSTRACT

A cosmetic unit comprising two different applicators each with a stem, each of the applicators dipping into a respective reservoir; each reservoir having an externally threaded neck on which to screw a coupling member; and the two reservoirs being releasably attachable to each other via a coupling sleeve by means of the coupling members which are screwed on and which simultaneously serve as a closure cap. The coupling members in the form of screw caps are non-rotarily attachable to the coupling sleeve by an axial serration and axially tightly attachable thereto by a beaded section engaging with a locking groove.

6 Claims, 1 Drawing Sheet

COSMETIC UNIT

BACKGROUND OF THE INVENTION

1. Field of the Invention

The invention relates to a cosmetic unit comprising two different applicators each with a stem, each of the applicators dipping into a respective reservoir; each reservoir having an externally threaded neck on which to screw a coupling member; and the two reservoirs being releasably attachable to each other via a coupling sleeve by means of the coupling members which are screwed on and which simultaneously serve as a closure cap.

2. Background Art

A cosmetic unit of the generic type is known from U.S. patent application Ser. No. 09/919 909. In the cosmetic unit of the species, the coupling members are externally threaded and can be screwed on the internal thread of the coupling sleeve for a connection to be produced. Owing to the combination of threads of the neck and the respective coupling member on the one hand and of the coupling members and the coupling sleeve on the other, a situation may arrive, in which a thread is unscrewed that had definitely not been intended to be operated, rendering the handling not quite satisfactory.

DE 197 33 290 A1 teaches a cosmetic applicator unit which comprises a brush as a first applicator and a wooden cosmetic pencil as a second applicator. The two applicators are tightly joined to each other and the junction is covered by a metal decoration sleeve. This solution may be very attractive, however it is rather costly, because special filling machines are needed for pouring a cosmetic such as nail enamel or mascara, and because the metal sleeve is expensive to manufacture and finish.

U.S. Pat. No. 5,509,742 A teaches a similar unit with a mascara brush provided on a first side and a mascara remover applicator on a second side. Via a plug type connection, this second applicator is joined to a coupling member where the brush is inserted.

It has also been disclosed to combine a nail enamel brush with a mascara applicator, it being possible to screw the respective reservoirs in an internally threaded connecting sleeve. U.S. Pat. No. 3,690,777 describes a similar design.

SUMMARY OF THE INVENTION

As in case of the prior art cosmetic unit of the generic type, it is an object of the invention to enable cosmetic compounds, for instance mascara, to be filled by conventional machines or inlets and to enable a consumer to use and combine the two units individually or, upon purchase, to suit them to personal wishes and requirements.

It is another object of the invention to increase the strength of the individual connections of the various components and to improve the handling thereof.

According to the invention, this object is attained in that the coupling members in the form of screw caps are non-rotatably attachable to the coupling sleeve by axial projections on the coupling sleeve corresponding to longitudinal flutings on the coupling member and that they are axially tightly attachable thereto by beaded sections engaging with locking grooves.

In keeping with a preferred embodiment, a recess is provided on the free edge of the coupling members to facilitate locking engagegment with the coupling sleeve.

By advantage, the recesses of the coupling sleeve and a corresponding section of the coupling members are slightly conical.

The fluting on the outside of the coupling members also serve to ease handling upon use as a screw cap as well as producing the non-rotary connection upon cooperation with corresponding longitudinal projections on the inside of the recess of the coupling sleeve.

In keeping with a favorable embodiment, the coupling sleeve has a central dividing wall that passes into the cylindrical wall of the coupling sleeve via sections of reduced width.

Provision may further be made for the coupling members to have a recess that extends axially from the external edge of the coupling members as far as into the vicinity of the locking groove.

Details of the invention will become apparent from the description of a preferred exemplary embodiment, taken in conjunction with the drawing:

DESCRIPTION OF THE PREFERRED EMBODIMENT

Figure 1:
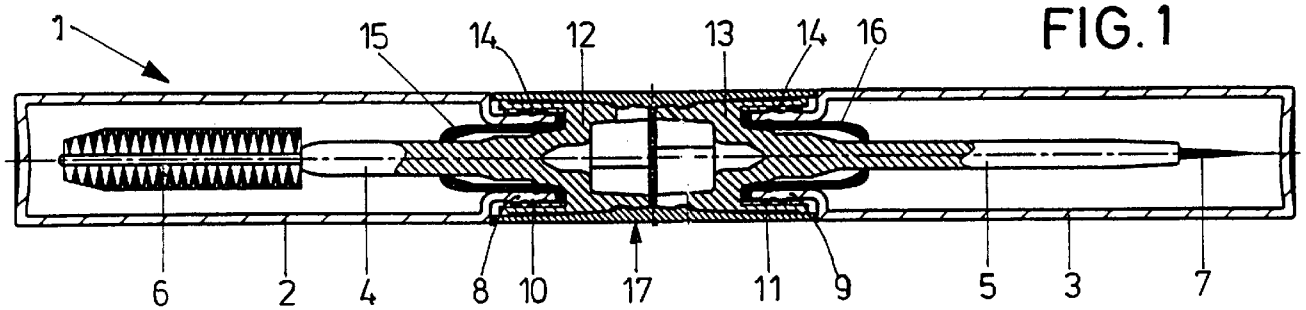
FIG. 1 is a longitudinal sectional view of a complete cosmetic unit according to the invention.
Figure 4:
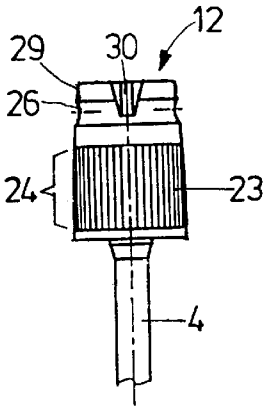
FIG. 4 is a lateral view of the coupling member.
Figure 3:
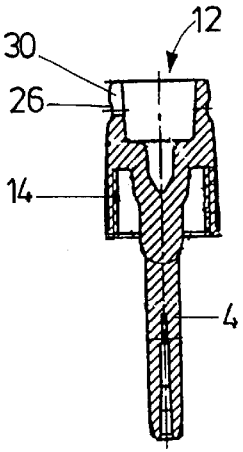
FIG. 3 is a longitudinal sectional view of a coupling member.

A cosmetic unit 1 seen in the drawing comprises two reservoirs 2, 3, each of which containing an applicator 6, 7 which is mounted on a stem 4, 5 and dips into a liquid cosmetic in the respective reservoir 2 and 3. In the embodiment, the applicator 6 is a mascara brush and the reservoir 2 holds liquid mascara, and the applicator 7 is a nail enamel brush and the reservoir 3 holds nail enamel.

Each reservoir 2, 3 has a tapered neck 8, 9 with an external thread 10, 11, with a coupling member 12 and 13 being screwed thereon by a corresponding internal thread 14, simultaneously serving as an individual closure cap. Each stem 4 and 5 is integrally joined to the respective coupling member 12 and 13. The coupling members 12. 13 may be made to have a recess 30 that extends axially from the external edge 29 of the coupling members as far as into the vicinity of a locking groove 26 further described below.

A wiper 15, 16 is inserted in each neck 8 and 9 in a manner known per se, with an annular collar of the wiper simultaneously serving as a packing on the top of each reservoir opening.

Figure 2:
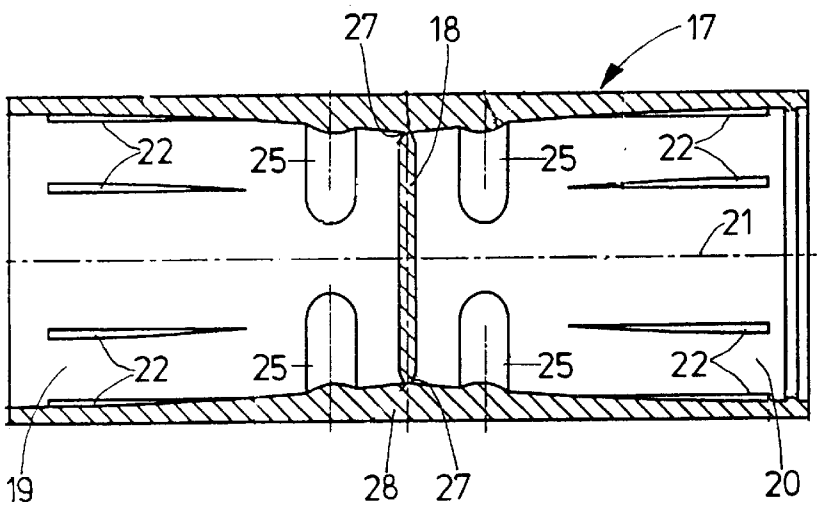
FIG. 2 is a longitudinal sectional view, on an enlarged scale, of the coupling sleeve of the cosmetic unit.

A coupling sleeve 17, which is enlarged in FIG. 2, serves to unite the two reservoirs 2 and 3.

The coupling sleeve 17 has two recesses 19, 20 which are separated by a dividing wall 18 that passes into an inside cylindrical wall 28 of the coupling sleeve via sections 27 of reduced width. The wall 18 also has inside projections 22 formed as a safeguard against rotation, the projections 22 extending in the direction of the longitudinal axis 21 i.e., axially, and cooperating with longitudinal flutings 23 on the outside of a slightly conical section 24 of the coupling members 12, 13 when the coupling members 12 and 13 are inserted into the recesses 19, 20 of the coupling sleeve 17.

For axial arrest to be implemented upon insertion, the recesses 19, 20 are provided with beaded sections 25 which are parallel to the dividing wall 18 and which engage with the locking groove 26 on the coupling members 12 and 13.

The axial recess 30 on the coupling members 12, 13 facilitates insertion of the coupling members into the coupling sleeve and therefore engagement of beaded sections 25 with the locking groove 26 which together form locking members.

This specified design according to the invention enables the individual reservoirs 2, 3 to be filled and handled by conventional machines of a manufacturer. The coupling members 12, 13 are screwed on in the way of conventional screw caps by available machines. The subunits thus produced after being filled individually as mentioned above—can be ordered individually by a retailer and offered as such on the market.

A consumer may choose the subunits at will and unite these subunits simply by plug type axial assembly.

For practical use, the reservoir 2 or 3 that is not needed can be screwed off the reservoir 3 or 2 that holds the liquid cosmetic to be used, serving as a kind of handle and ensuring ease of handling. Wiping and dipping takes place conventionally.

Once a reservoir 2, 3 is empty, there is no need to dump the entire unit; instead, the plug type connection can be released and the completely or partially filled unit, which is still fit for use, may be combined with a fresh subunit by replacement of the empty subunit, with either the original combination being restored or another combination being produced that complies with a consumer's wishes.

By advantage, the coupling sleeve consists of plastic material, for example ABS, PP, PE, PA or PET. Favorably, the forces of joining and separating the axial connection between the coupling members 12 and 13 and the coupling sleeve 17 are in the range of 150 to 160 N, however they may also range from 15 to 300 N.

The beaded sections 25 favorably comprise three segments of a circle.

What is claimed is:

1. A cosmetic unit (1) comprising two different applicators (6, 7) each with a stem (4, 5), each of the applicators (6, 7) dipping into a respective reservoir; each reservoir (2, 3) having a neck (8, 9) with an external thread (10, 11) on which to screw a coupling member (12, 13); and the two reservoirs (2, 3) being releasably attachable to each other via a coupling sleeve (17) by means of the coupling members (12, 13) which are screwed on and which simultaneously serve as a closure cap;

wherein the coupling members (12, 13) in the form of screw caps are non-rotarily attachable to the coupling sleeve (17) by axial projections on the coupling sleeve corresponding with longitudinal flutings on the coupling members and are axially tightly attachable thereto by beaded sections (25) engaging with locking grooves (26) which together form locking members (25, 26).

2. A cosmetic unit according to claim 1, wherein at least one recess 30 is provided on a free edge (29) of the coupling members (12, 13) for facilitating insertion of the coupling members into the coupling sleeve and engagement of the beads of sections (25) in the locking grooves (26).

3. A cosmetic unit according to claim 2, wherein the coupling members (12, 13) are externally provided with the longitudinal flutings (23), which ensures ease of handling upon use as a screw cap as well as producing the non-rotary connection upon cooperation with corresponding the axial projections (22) on an inside of the recess (19, 20) of the coupling sleeve (17).

4. A cosmetic unit according to claim 2, wherein the recess (30) extends axially from the free edge (29) of the coupling members (12) as far as into the vicinity of the locking groove (26).

5. A cosmetic unit according to claim 1, wherein recesses (19, 20) on the coupling sleeve (17) and a section (24) of the coupling members 12, 13 on which the flutings (23) are located are slightly conical.

6. A cosmetic unit according to claim 1, wherein the coupling sleeve (17) has a central dividing wall (18) which, via sections (27) of reduced width, passes into a cylindrical wall (28) of the coupling sleeve (17).

* * * * *